US005795041A

United States Patent [19]

Weaver

[11] Patent Number: 5,795,041

[45] Date of Patent: Aug. 18, 1998

+

[54] HOME THEATER BRIDGE

[75] Inventor: Michael E. Weaver, Jamestown, N.Y.

[73] Assignee: Bush Industries, Inc., Jamestown, N.Y.

[21] Appl. No.: 833,236

[22] Filed: Apr. 14, 1997

Related U.S. Application Data

[60] Provisional application No. 60/016,337, Apr. 15, 1996.

[51] Int. Cl.[6] ..... A47B 45/00

[52] U.S. Cl. ..... 312/205; 108/42

[58] Field of Search ..... 312/203, 205, 312/7.2, 111; 108/42, 65, 39

[56] References Cited

U.S. PATENT DOCUMENTS 3,353,885 11/1967 Hanson ..... 312/205

5,303,057 4/1994 Davidow et al. ..... 312/205

FOREIGN PATENT DOCUMENTS 63474 2/1913 Switzerland ..... 312/205

*Primary Examiner*—Peter M. Cuomo
*Assistant Examiner*—Gerald A. Anderson
*Attorney, Agent, or Firm*—Webb Ziesenheim Bruening Logsdon Orkin & Hanson, P.C.

[57] ABSTRACT

The present invention discloses a universal cabinet structure receiving a television set therein. The cabinet includes a pair of adjustably positioned towers which define an adjustable television set receiving area between the towers. An adjustable bridging element is arranged between the towers to accommodate the adjustment of the respective towers. A fixed, one-piece front trim member is attached to the adjustable bridging element and extends at least a distance between the spaced towers.

16 Claims, 4 Drawing Sheets

HOME THEATER BRIDGE

The present application claims the benefit under 35 U.S.C. § 119(e) of co-pending provisional application Ser. No. 60/016,337, to the same inventor, filed on Apr. 15, 1996 entitled "Home Theater Bridge."

BACKGROUND OF THE INVENTION

1. Field of the Invention

The present invention relates to television cabinets and, more specifically, the present invention relates to a television cabinet adjustable to receive televisions of a variety of sizes.

2. Prior Art

Television receiving cabinets having adjustable television openings therein have been known in the prior art in a variety of configurations. U.S. Pat. No. 5,303,057 to Davidow et al. discloses one adjustable television cabinet structure which includes a pair of spaced-apart towers which are adjustable relative to each other. The adjustable towers are provided with an adjustable bridging element therebetween. The bridging element includes a center sheet 96 with a pair of shiftable members 92 and 94 on either end. A decorative facia or trimming 102 is provided on the front edges of both the center sheet 96 and the shiftable members 92 and 94 in an overlapping configuration to present a continuous overall cabinet structure. The difficulty with the cabinet design of the Davidow et al. '057 patent is that with the center sheet 96, shiftable members 92 and 94, trim piece 102 and the trim pieces on the shiftable members, the bridging element can sag across the top of the cabinet The sagging of the bridging element effectively limits the extension of the bridging element in the Davidow et al. '057 patent.

SUMMARY OF THE INVENTION

It is an object of the present invention to overcome the aforementioned drawbacks of the prior art. Specifically, it is an object of the present invention to provide an adjustable bridging element between a pair of shiftable towers which minimizes or substantially eliminates sagging of the bridging element between the adjustable towers. The objects of the present invention are achieved by providing a television receiving cabinet structure for receiving a television set therein of a wide range of sizes. The cabinet structure includes a pair of relatively adjustable, spaced-apart towers defining a television set receiving area between the adjustable, spaced-apart towers. An adjustable bridging element spanning the towers will determine the horizontal distance between the towers. The adjustable bridging element includes a center member and at least one shiftable end member, whereby the length of the adjustable bridging element may be adjusted by moving at least one of the adjustable end members relative to the center member. The bridging element includes a one-piece front trim member extending at least the entire distance between said spaced towers with the front trim member being attached to the bridging means.

In one embodiment of the present invention, the bridging element includes the center member and a pair of shiftable end members on either end of the center member. Additionally, an attachment mechanism may be provided for attaching each of the end members to one of the pair of spaced-apart towers. The attachment mechanism may include a shim, if needed, for raising the top surface of the end member to the top surface of the adjacent tower and at least one bracket extending between the end member and the top of the adjacent tower.

These and other advantages of the present invention will be clarified in the description of the preferred embodiment taken together with the attached figures, wherein like reference numerals represent like elements throughout.

BRIEF DESCRIPTION OF THE PREFERRED EMBODIMENT

Figure 1:
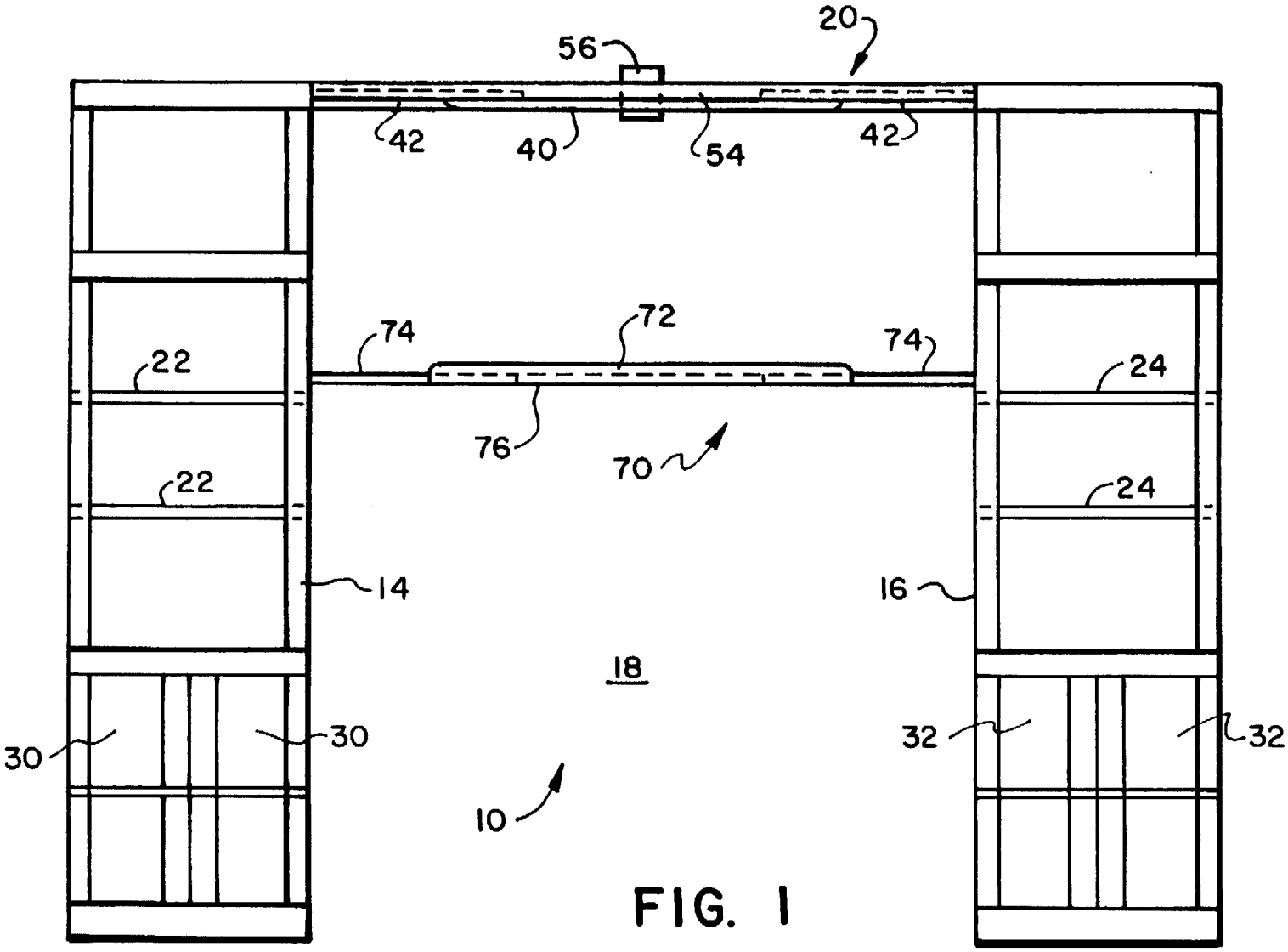
FIG. 1 is a front elevational view of a television cabinet according to the present invention with the cabinet in a rest position.

A television cabinet 10 according to the present invention is illustrated in FIGS. 1–6. The television cabinet 10 includes a pair of spaced-apart towers 14 and 16, each of generally conventional construction. The towers 14 and 16 include a television receiving area 18 therebetween which is adapted to receive a television set therein (not shown). The television set is preferably a projection television set which can be used effectively with the television cabinet 10 of the present invention.

The towers 14 and 16 of the cabinet 10 are adjustable relative to each other as shown by the two representative positions shown in FIGS. 1 and 3 and FIGS. 2 and 4. Aside from the adjustability of the towers 14 and 16, these towers are of a generally conventional construction and include a plurality of shelves 22 and 24 with doors 30 and 32 for gaining access to an interior storage compartment having additional shelves or other storage compartments. Additionally, as is well known in the art, the shelves 22 and 24 may be provided in an adjustable manner so the user can position the shelving in a desired location.

To create the universal structure of the present invention, the television receiving area 18 is adjustable in width and height so that the space will specifically accommodate the variety of television sizes. To accommodate the adjustable towers 14 and 16, an adjustable bridging element 20 extends between the pair of spaced towers 14 and 16. The adjustable bridging element 20 is analogous to the adjustable bridging element described in the Davidow et al. '057 patent discussed above which is incorporated herein by reference. The adjustable bridging element 20 of the present invention includes a number of advantages over the adjustable bridging element described in the Davidow et al. '057 patent, as will be described hereinafter. The adjustable bridging element 20 includes a center plate 40 with a pair of adjustable end plates 42 on either side of the center plate 40. The center plate 40 includes a plurality of adjustment holes 44 to which each end plate 42 may be selectively attached to the center plate 40 at a variety of adjustable positions by bolts (not shown) extending through slots 46 in each end plate 42 as shown in the drawings. The adjustability of the adjustable bridging element 20 is most clearly illustrated in a comparison of the two representative positions shown in FIGS. 3 and 4.

The end of each end plate 42 spaced farthest from the center plate 40 may include a shim member (not shown), if needed, to raise the top surface of each end plate 42 to the same level as the top of each associated tower 14 and 16. Flat, rectangular metal brackets 50 overlay the end plates 42 and the associated towers 14 and 16 and are connected thereto by appropriate fasteners 52. The brackets 50 may also be designed to accommodate any offset between the level of the top surface of each end plate 42 and the level of the top surface of the associated towers 14 and 16 eliminating the need for any shim.

Figure 2:
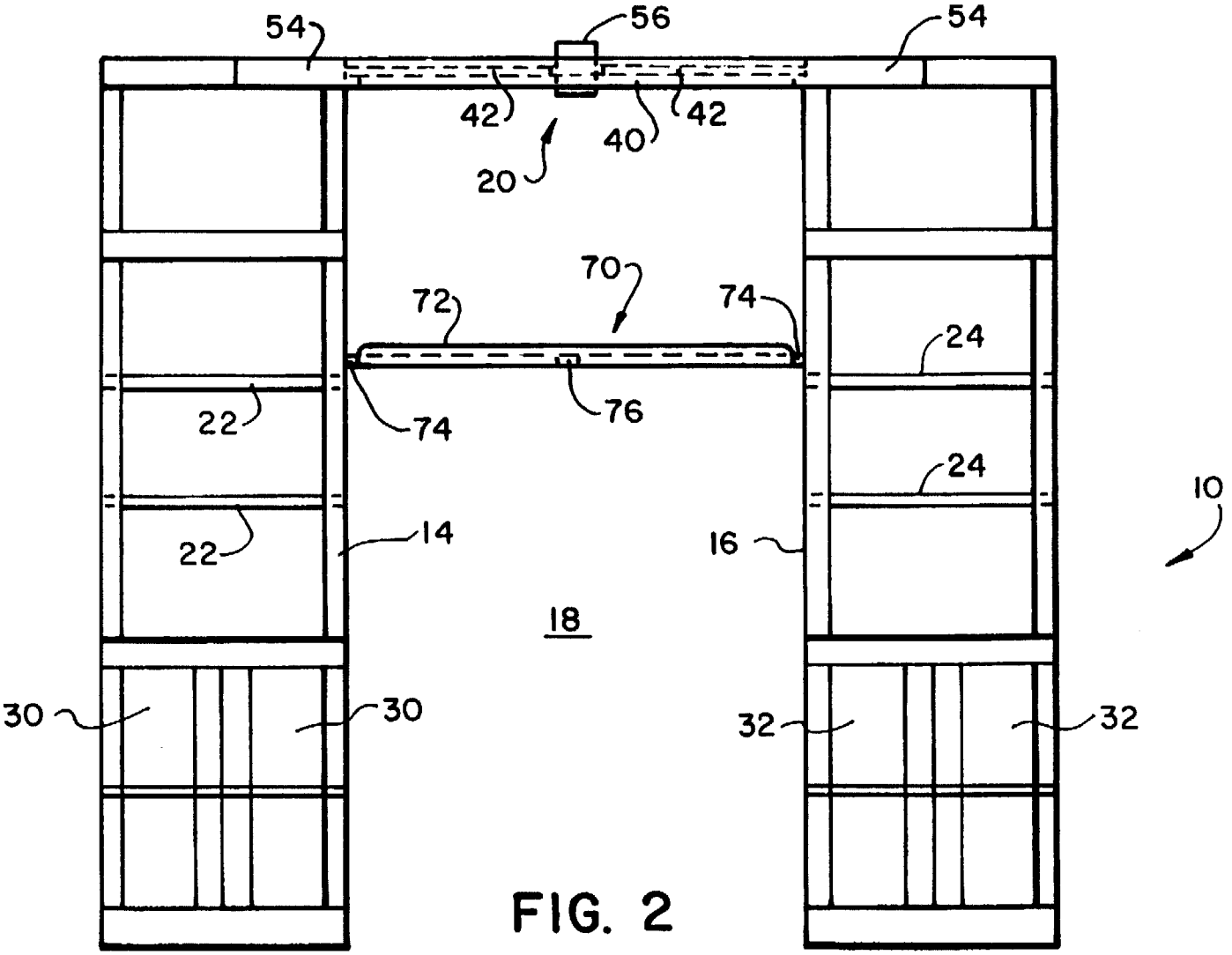
FIG. 2 is a front elevational view of the cabinet illustrated in FIG. 1 in a second position.
Figure 3:
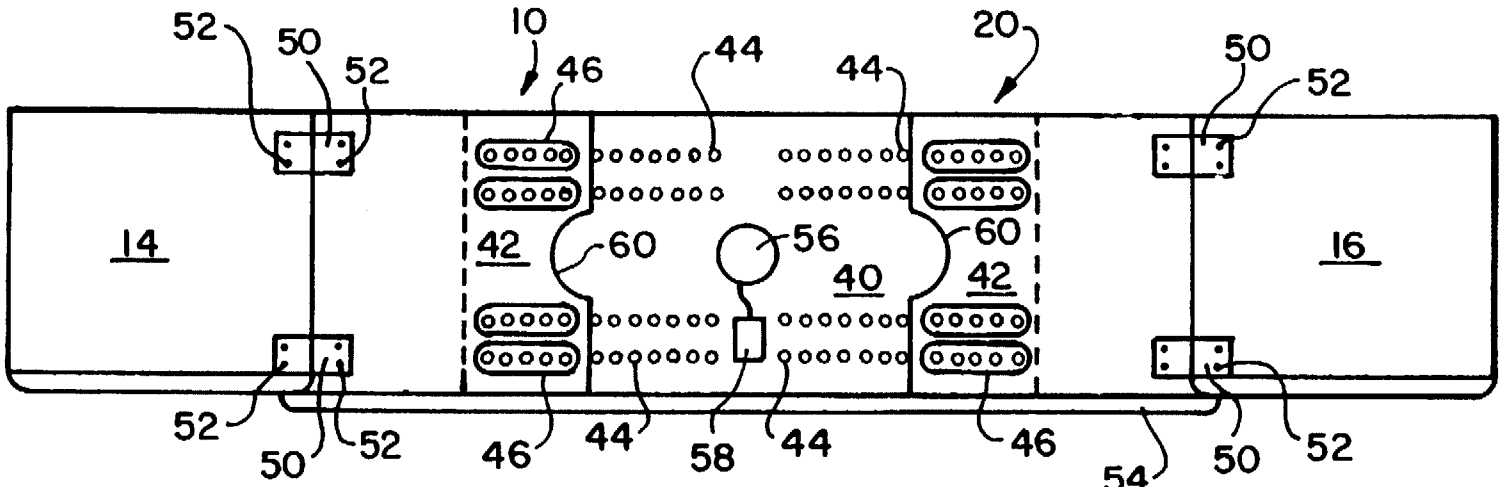
FIG. 3 is a plan view of the cabinet illustrated in FIG. 1 in the first position.
Figure 4:
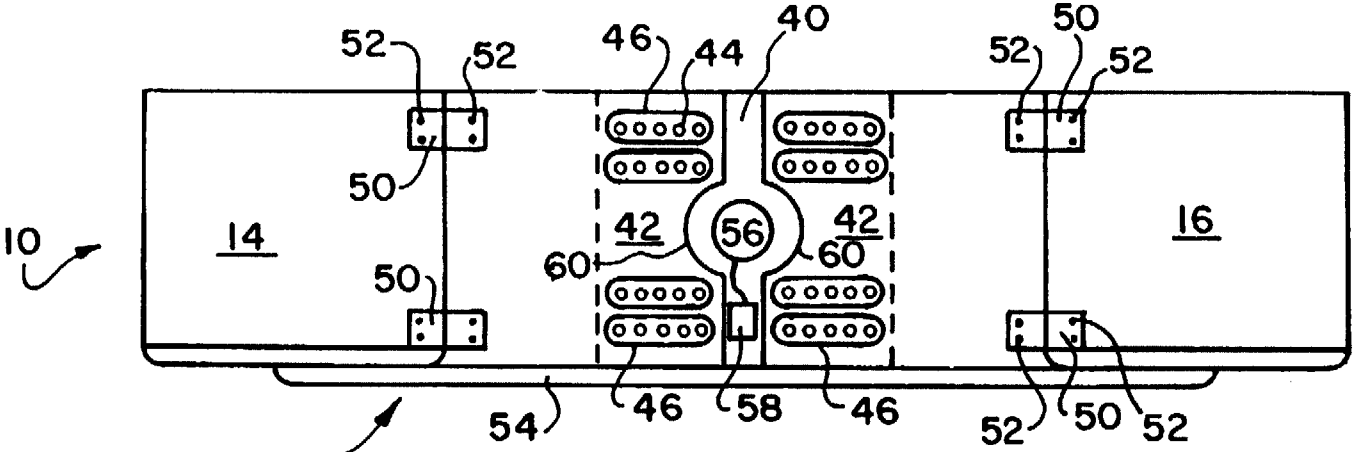
FIG. 4 is a plan view of the cabinet illustrated in FIG. 1 in the second position.
Figure 5:
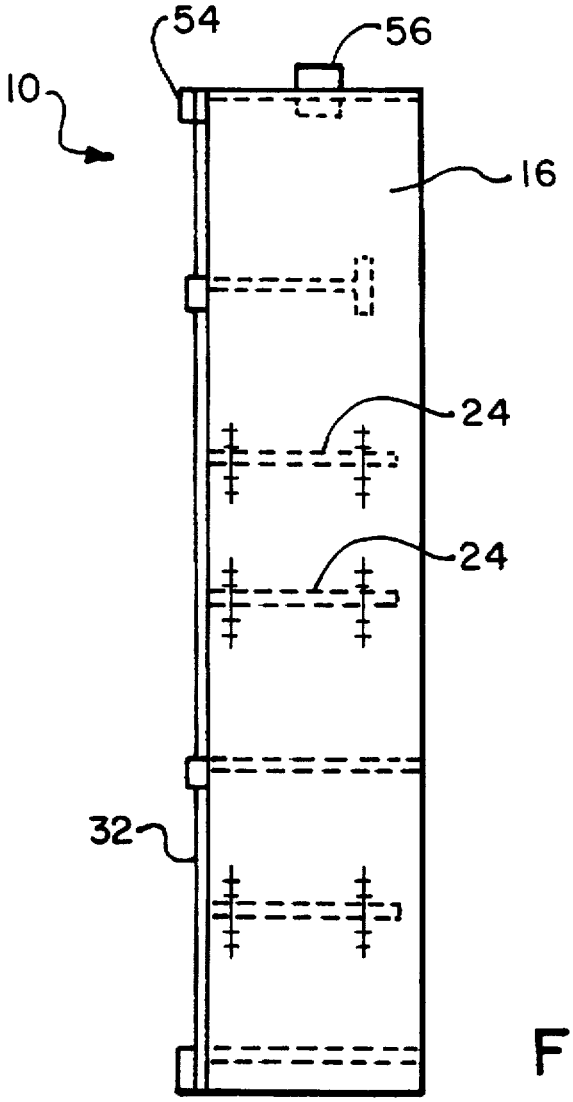
FIG. 5 is a side elevational view of the cabinet illustrated in FIGS. 1–4.

The adjustable bridging element 20 of the present invention Includes a single, fixed distance, one-piece trim member 54 extending across the top thereof. The trim member 54 extends at least the distance between the towers 14 and 16 as shown in FIG. 1. The trim member 54 will align with top trim members of each tower 14 and 16 to present a continuous trim configuration across the top of the entire cabinet 10. Additionally, as the towers 14 and 16 are adjusted closer toward each other, the trim member 54 will overlay the trim member of each tower 14 and 16 to allow for this adjustability as shown in FIG. 2. The trim member 54 is preferably secured to the center plate 40. Additionally, the trim member 54 may include a groove therein on a back surface thereof to slidably receive each end plate 42 therein to further support the adjustable bridging element 20. It is further anticipated that the trim member 54 may be secured to the towers 14 and 16 after the cabinet 10 has been adjusted to the appropriate location.

The trim member 54 of the present invention provides the necessary support for the overall adjustable bridging element 20 to prevent any sagging of the bridging element 20, even at the widest extension of the towers 14 and 16 as shown in FIG. 1. The support provided by the trim member 54 allows a lighting unit 56 to be secured within the center plate 40 which is controlled by a conventional switch 58. Cutouts 60 may be provided on the end plates 42 to accommodate the lighting unit 56 when the end plates 42 and the associated adjustable bridging element 20 are in the narrowest or most closed position.

Figure 6:
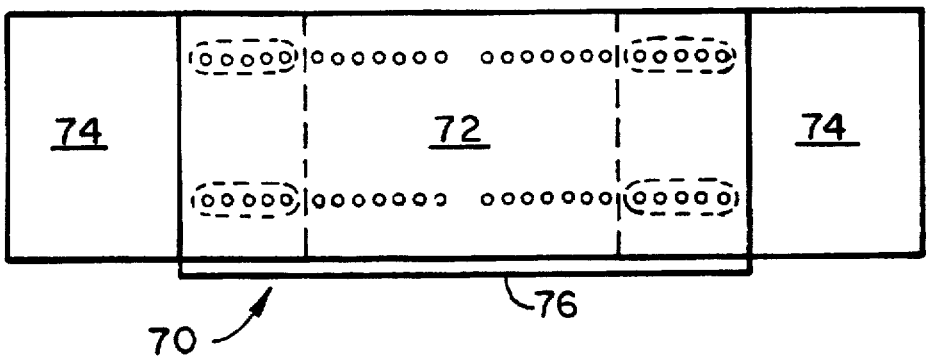
FIG. 6 is a top plan view of an adjustable shelf of the cabinet illustrated in FIGS. 1–5.

The cabinet 10 includes an adjustable shelf member 70 positioned below the adjustable bridging element 20. As shown in FIG. 6, the adjustable shelf member 70 includes a shelf center plate 72 and a pair of adjustable shelf end plates 74 adjustably coupled to the shelf center plate 72 in the same manner as end plates 42 are adjustable to center plate 40 in the adjustable bridging element 20 discussed above. The adjustable shelf member 70 may additionally include a front trim member 76. The adjustable shelf member 70 is adjustable in width substantially the same as the adjustable bridging element 20 described above. Furthermore, it is advantageous to provide the adjustable shelf member 70 as vertically adjustable such that the television receiving area 18 can be more closely adjusted to the specific size of the television set. The vertical adjustment of the adjustable shelf member 70 is usually made in the same manner as the adjustable shelves 22 and 24 of the towers 14 and 16. For example, a plurality of pegged locations may be provided on the exterior surface of the towers 14 and 16 to accommodate the variable vertical positioning of the adjustable shelf member 70.

It will be apparent to those of ordinary skill in the art that various modifications may be made to the present invention without departing from the spirit and scope thereof. Consequently, the scope of the present invention is intended to be defined by the appended claims.

What is claimed is:

1. A cabinet structure for receiving a television set having a fixed height and width, the structure comprising:

a pair of adjustable, spaced towers defining an adjustable television set receiving area between the towers, said pair of spaced towers including trim members; and an adjustable bridging means spanning the towers for determining the horizontal distance between the towers, said bridging means including a center plate, at least one adjustable end plate adjustably attached to said center plate and a single, one-piece trim member spanning at least between the spaced towers, wherein said trim member of said adjustable bridging means is aligned with said trim members of said pair of spaced towers, and wherein said trim member of said bridging means includes a groove on a back surface of said trim member which slidably receives each said end plate.

2. The cabinet structure of claim 1 further including a vertically adjustable shelf member extending between said pair of spaced towers, said vertically adjustable shelf member defining an upper end of said television set receiving area.

3. The cabinet structure of claim 2 wherein said vertically adjustable shelf member includes a shelf center plate and at least one adjustable shelf end plate adjustably attached to said shelf center plate.

4. The cabinet structure of claim 1 wherein said adjustable bridging means further includes a bracket overlaying each said end plate and an adjacent spaced tower.

5. The cabinet structure of claim 1 further including a lighting unit secured to said center plate of said adjustable bridging means.

6. The cabinet structure of claim 1 further including a lighting unit secured to said center plate of said adjustable bridging means.

7. The cabinet structure of claim 6 wherein each said end plate includes a cutout therein adapted to accommodate said lighting unit when said adjustable bridging means is in a narrowest position.

8. The cabinet structure of claim 7 further including a vertically adjustable shelf member extending between said pair of spaced towers, said vertically adjustable shelf member defining an upper end of said television set receiving area.

9. The cabinet structure of claim 8 wherein said vertically adjustable shelf member includes a shelf center plate and at least one adjustable shelf end plate adjustably attached to said shelf center plate.

10. A cabinet structure for receiving a television set having a fixed height and width, the structure comprising:

a pair of adjustable, spaced towers defining an adjustable television set receiving area between the towers, said pair of spaced towers including trim members; and an adjustable bridging means spanning the towers for determining the horizontal distance between the towers, said bridging means including a single, one-piece trim member spanning at least between the spaced towers, wherein said trim member of said adjustable bridging means is aligned with said trim members of said pair of spaced towers, and wherein said trim member of said adjustable bridging means is adapted to overlay said trim members of said pair of spaced towers at least when said pair of adjustable, spaced towers and said adjustable bridging means are in the closest position.

11. The cabinet structure of claim 8 wherein said adjustable bridging means includes a center plate and at least one adjustable end plate adjustably attached to said center plate.

12. The cabinet structure of claim 11 further including a lighting unit secured to said center plate of said adjustable bridging means.

13. The cabinet structure of claim 11 wherein said trim member of said bridging means includes a groove on a back surface of said trim member which slidably receives each said end plate therein.

14. The cabinet structure of claim 10 further including a vertically adjustable shelf member extending between said pair of spaced towers, said vertically adjustable shelf member defining an upper end of said television set receiving area.

15. The cabinet structure of claim 14 wherein said vertically adjustable shelf member includes a shelf center plate and at least one adjustable shelf end plate adjustably attached to said shelf center plate.

16. The cabinet structure of claim 15 wherein said adjustable bridging means includes a center plate and at least one adjustable end plate adjustably attached to said center plate.

* * * * *

UNITED STATES PATENT AND TRADEMARK OFFICE

CERTIFICATE OF CORRECTION

PATENT NO. : 5,795,041

DATED : August 18, 1998

INVENTOR(S) : Michael E. Weaver

It is certified that error appears in the above-identified patent and that said Letters Patent is hereby corrected as shown below:

Title Page, under [56] References Cited, U.S. PATENT DOCUMENTS, insert:
--4,002,831 1/1977 Aeschliman.....358/254--.

Column 1 Line 31 between "cabinet" and "The" insert period --.--.

Column 2 Lines 9-10 "in a rest position" should read --in a first position--.

Column 3 Line 13 "Includes" should read --includes--.

Claim 11 Column 5 Line 1 "of claim 8" should read --of claim 10--.

Signed and Sealed this

Twelfth Day of January, 1999

*Attest:*

*Attesting Officer*

*Acting Commissioner of Patents and Trademarks*